US005343567A

United States Patent [19]

Zumbiel

[11] Patent Number: 5,343,567

[45] Date of Patent: Sep. 6, 1994

[54] SIMULATED BASEBALL CAP

[76] Inventor: Michael W. Zumbiel, 5026 Relleum Ave., Cincinnati, Ohio 45238

[21] Appl. No.: 18,057

[22] Filed: Feb. 16, 1993

[51] Int. Cl.[5] ..... A42B 1/00

[52] U.S. Cl. ..... 2/195.1; D2/869; D2/872

[58] Field of Search ..... 2/171, 175, 192, 194, 2/195, 200, 201; D2/244, 248, 250, 509, 510, 511

[56] References Cited

U.S. PATENT DOCUMENTS

| | | | |
|---|---|---|---|
| D.230,103 | 1/1974 | Hyatt | D2/250 |
| D.279,137 | 6/1985 | Sing | D2/248 |
| D.292,342 | 10/1987 | Schlegel | D2/248 |
| D.303,036 | 8/1989 | Giles | D2/248 |
| D.311,267 | 10/1990 | Pesta | D2/250 |
| 4,222,125 | 9/1980 | Sewell-Wood | 2/195 |

OTHER PUBLICATIONS

1978 *Brine* Advertisement, p. 19.

*The Sporting Goods Dealer* / Aug., 1982, p. 143.

*Primary Examiner*—Clifford D. Crowder

*Assistant Examiner*—Diana L. Biefeld

*Attorney, Agent, or Firm*—Wood, Herron & Evans

[57] ABSTRACT

A cap to be worn on the top of the head comprises a crown that is fabricated to simulate approximately one-half of a game ball. The crown is formed by a plurality of generally triangular-shaped fabric gores which are collectively stitched together along their lengthwise edges, and the outer surface of each of the gores includes a pattern section which, when individual fabric gores are secured together to form the crown, are aligned to provide a half game ball.

1 Claim, 3 Drawing Sheets

SIMULATED BASEBALL CAP

FIELD OF THE INVENTION

This invention relates generally to caps for the head. More particularly, this invention relates to a cap with a unique crown which simulates approximately one-half of a game ball.

BACKGROUND OF THE INVENTION

Caps have traditionally adorned wearers' heads for a variety of different reasons, such as for warmth or to shield the wearer's eyes from the sun. One type of popular cap worn today takes the shape of a traditional baseball cap, i.e., a cap like that worn by the members of a baseball team. A baseball cap basically comprises a generally hemispherically shaped crown with a substantially flat brim that juts out from the crown above the wearer's eyes when the cap is worn. While caps of such design are often associated with the sport of baseball, the baseball cap design has received widespread popularity for other purposes, such as for caps to promote athletic teams of other sports like football and basketball, for caps to promote a sponsor company or product, or as caps just for general wear and usage.

SUMMARY OF THE INVENTION

The unique cap of the present invention comprises a crown that is fabricated to simulate about one-half of a game ball, e.g., about one-half of a baseball, or a basketball, or a soccer ball, etc. The crown preferably comprises a plurality of generally triangular-shaped fabric gores which are collectively stitched or otherwise attached together along their lengthwise edges to form the crown of the cap. The outer surface of each of the crown gores includes a pattern section which, when the individual fabric gores are secured together to form the cap's crown, are aligned to provide a game ball pattern which simulates approximately one-half of a game ball. In other words, the simulated game ball pattern is not completely contained on any one of the cap's individual gores, but the simulated half of the game ball is formed only when the gores are secured together to form the cap's crown.

The pattern sections on the outer surface of the cap's gores, which collectively simulate the half of the game ball when assembled together to form the cap's crown, include a plurality of simulated seams that are normally present on the outside of a particular game ball. Depending upon the orientation of these simulated seams on the ball and the type of game ball to be formed by the cap's crown when the fabric gores are secured together to form the crown, at least one of the simulated seams of the ball may overlie at least a part of the fabric seam between two adjacent fabric gores. Alternatively, the other simulated seams may not align with the fabric seam between adjacent gores, but rather will traverse the fabric gore seams at appropriate angles.

The simulated game ball on the cap's crown can be any one of a number of essentially round game balls, and therefore, alternative embodiments of the present invention disclose various simulated game balls formed on the crown. For example, the crown of the cap of the present invention can be made to simulate a half of either a baseball, a basketball, a soccer ball, or a tennis ball, among a variety of other game balls, and the present invention is not limited to any specific game ball.

Other objects and advantages of the present invention will become apparent from the following detailed description when read in connection with the accompanying drawings.

DETAILED DESCRIPTION OF THE INVENTION

Figure 1:
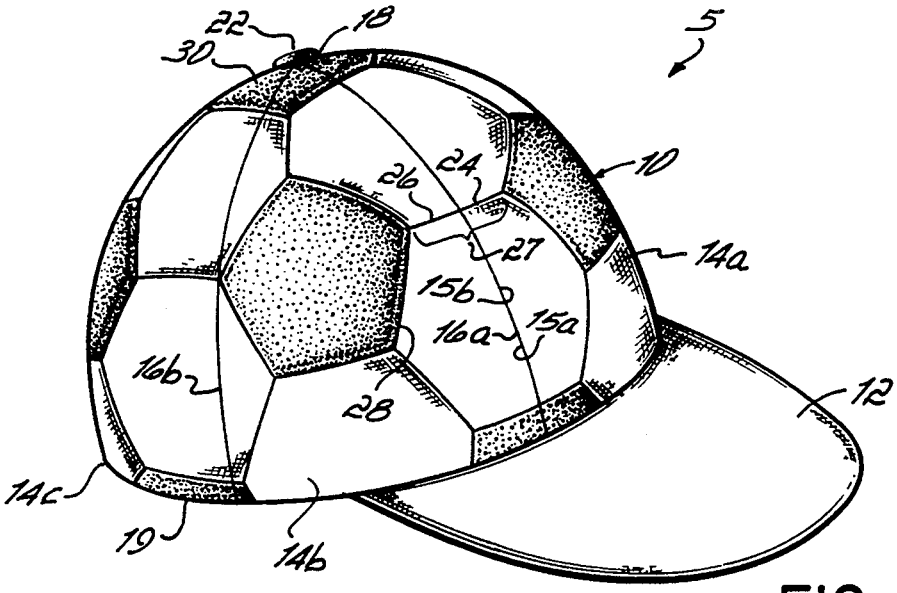
FIG. 1 is a perspective view of one embodiment of the cap of the present invention.

Referring now to FIG. 1, a cap 5 is shown having a crown 10 and a bill 12. Cap 5 resembles a baseball-style cap which has been worn traditionally for the game of baseball. However, caps of such style have gained popularity for general wear and for a variety of other activities and sports over the years. The crown 10 of cap 5 is made up of a plurality of generally triangular-shaped fabric gores 14*a*, 14*b*, 14*c*, 14*d*, 14*e*, and 14*f* which each have opposed lengthwise edges 15*a* and 15*b* and a base edge 15*c*, see FIG. 2. The gores 14*a–f* are stitched or otherwise secured together in final assembly along their opposing lengthwise edges 15*a–b* to collectively form the crown of cap 5. When secured together, the contiguous loose edges 15*c* of the gores form the head-receiving opening of the cap's crown 10. In the assembled crown 10, the opposing edges 15*a–b* of adjacent gores, such as gores 14*a* and 14*b*, form fabric seams 16*a* and 16*b* as shown in FIG. 1. Generally, the point 18 at the top of the crown, where the tips 20*a–f* of fabric gores 14*a–f*, respectively, come together in the assembled cap is covered with a button 22 to secure the tips 20*a–f* together at the top of the crown 10 and to improve the aesthetic look of the cap 5.

Figure 2:
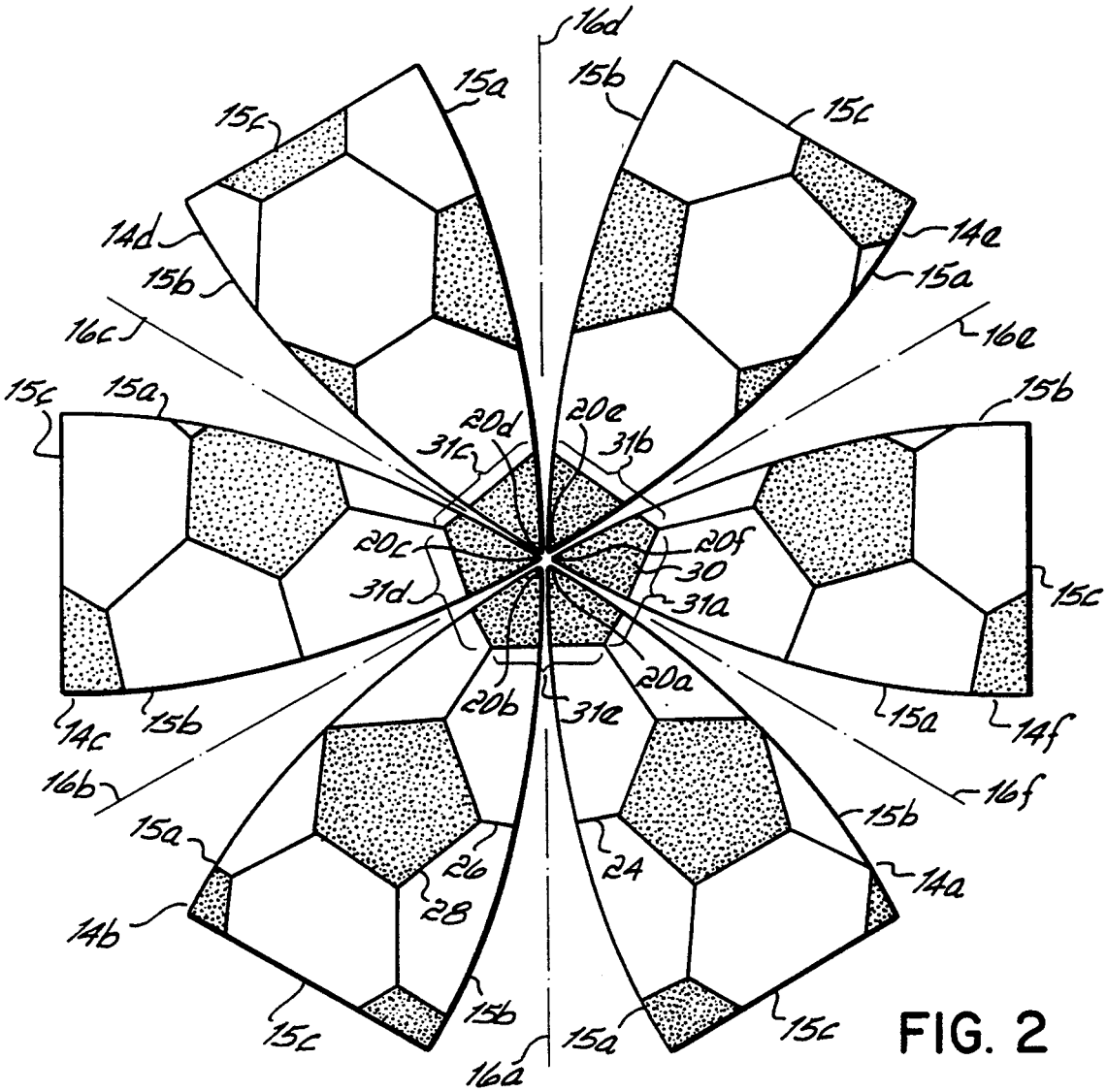
FIG. 2 is a top plan view of the unassembled fabric gores used to assemble the cap shown in FIG. 1.

Referring now to FIG. 2, it may be seen that each of the generally triangular fabric gores 14*a–f* contains a pattern section provided, e.g., by printing or stitching, on the upper surface of the gore. The stippling shading depicted in FIGS. 1 and 2 is done for illustrative purposes to show a contrast in color and not to show a particular texture. When the gores 14*a–f* are secured together, one to the other, along their lengthwise edges 15*a* and 15*b* to form the crown 10 of the cap 5, the pattern sections on the gores 14*a–f* collectively create the complete pattern which simulates approximately one-half of a game ball. Depending upon the pattern sections contained on the upper surfaces of fabric gores 14*a–f*, the game ball simulated by the assembled cap crown 10 will resemble any one of a number of generally round game balls such as the soccer ball half shown in FIG. 1.

The gores 14*a–f* of FIG. 1 and FIG. 2 each contain pattern sections of a soccer ball. The pattern sections on the surface of the gores 14*a–f* include various simulated ball seams, such as simulated ball seams 24, 26, and 28. When the adjacent gores, such as 14*a* and 14*b* of FIG. 1, are secured together along fabric seam 16*a*, the simulated ball seam 24 in the pattern section of gore 14*a* aligns with the simulated ball seam 26 in the pattern section of gore 14*b*, as do other simulated seams in the pattern section of other adjacent gores, to collectively simulate the well known hexagonal and pentagonal black and white patches on the outer surface of a soccer ball. As may be appreciated from FIG. 1, when a crown 10 is formed, several of the simulated seams in the gore pattern sections, such as seams 24 and 26, meet to form completed simulated ball seams, such as seam 27, and the completed seam 27 traverses the fabric gore seam 16*a* between opposing lengthwise edges 15*a–b* of adjacent gores 14*a* and 14*b*. Several other simulated ball seams traverse other gore seams at other locations on crown 10. However, still other simulated ball seams in the crown pattern, such as seam 28, do not traverse any fabric seams of the adjacent assembled gores.

When one of the five-sided patches 30 of the simulated soccer ball half is situated at the top or point 18 of the crown 10, the simulated ball seams surrounding the patch traverse each of the fabric seams 16*a*, 16*b*, 16*c*, 16*d*, 16*e*, and 16*f* which extend between adjacent fabric gores from the top 18 of the cap crown 10 down to the bottom of the crown 19. As seen in FIG. 2, five-sided simulated patch 30 will be centered approximately at the top of the crown 10 when the gores 14*a–f* are secured together, and the simulated ball seams 31*a–e* traverse each of the fabric seams 16*a–f* between adjacent fabric gores.

Figure 3:
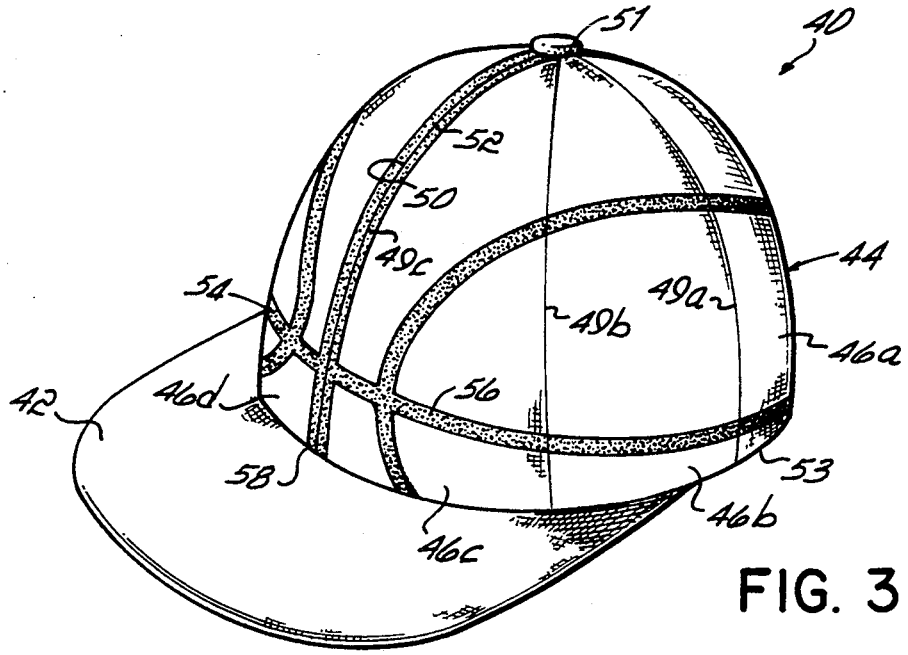
FIG. 3 is a perspective view of a first alternative embodiment of the cap of the present invention.
Figure 4:
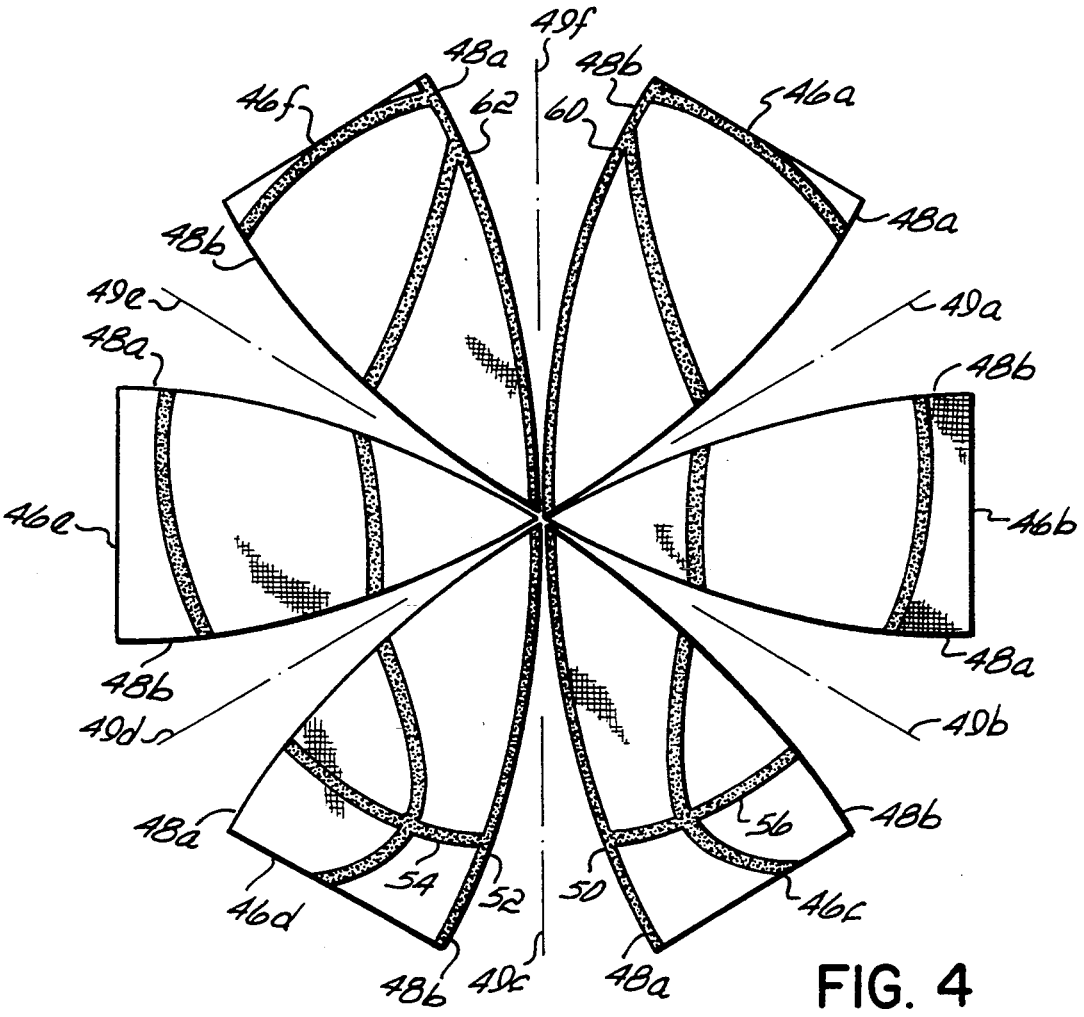
FIG. 4 is a top plan view of the unassembled fabric gores used to assemble the cap shown in FIG. 3.

Alternative embodiments of the cap 5 of the present invention utilize fabric gores which, when assembled together into a cap crown, create a pattern that simulates approximately one half of various different game balls having a generally round shape. For example, FIG. 3 shows a cap 40 which includes a bill 42 and a crown 44, and the pattern sections on the gores of the crown simulate approximately one-half of a basketball. The fabric gores 46*a–f* of cap 40 are arranged and secured together into crown 44 similar to the way that gores 14*a–f* are assembled to form crown 10 of cap 5, as described and shown hereinabove in FIGS. 1 and 2. The fabric gores 46*a–f* (only gores 46*a*, 46*b*, 46*c*, and 46*d* are visible in FIG. 3) are secured together along opposing lengthwise edges 48*a* and 48*b* to form crown 44. As seen in FIG. 4, each of the fabric gores 46*a–f* includes a pattern section on the outer surface of the gore, and the pattern sections contains various simulated ball seams, such as simulated ball seams 50, 52, 54, and 56. When the gores 46*a–f* are assembled together to form crown 44, the simulated ball seams 50, 52, 54 and 56 of the gores 46*a–f*, i.e., the pattern sections of the assembled gores, collectively simulate approximately one-half of a basketball on the crown 44 as shown in FIG. 3.

Depending upon the shape and layout of all of the simulated ball seams on the pattern sides of the fabric gores 46*a–f*, various simulated ball seams either traverse or overlie the fabric seams 49*a–f* between adjacent gores (only fabric seams 49*a–c* are visible in FIG. 3, i.e., the fabric seams 49*a–f* extend from the top of the crown 51 to the bottom of the crown 53, at various angular spacings around crown 44 of cap 40. When adjacent gores 46*c* and 46*d* are secured together along fabric seam 49*c*, the simulated ball seams 50 and 52 of the gores 46*c* and 46*d*, respectively, join to cream completed simulated ball seam 58 which completely overlies fabric seam 49*c*. Therefore, in the embodiment shown in FIG. 3, at least one of the fabric seams between the opposing edges of adjacent fabric gores completely aligns with simulated ball seam 58 of the simulated basketball half. However, the other various simulated seams of the basketball half of FIG. 3, such as seams 54 and 56, meet at fabric seam 49*c* between fabric gores 46*c* and 46*d* to traverse seam 49*c* almost perpendicular to seam 49*c*. In this way, the simulated ball seams of the individual fabric gores 46*a–f* meet to form all of the ball seams of the simulated basketball half when the gores are assembled into crown 44 of cap 40. In other words, while the simulated ball seam 58 overlies fabric seam 49*c* towards the front of the crown 44, the simulated ball seams 60 and 62 (FIG. 4) meet to form a completed seam (not shown) which is analogous to simulated ball seam 58 and which overlies fabric seam 49*f* located approximately at the back of the cap opposite seam 49*c*. Therefore, depending upon the type of game ball which is simulated by the pattern sections on the crown 44 of cap 40, various simulated ball seams of the simulated game ball half may completely overlie a fabric seam of the crown 44, while other simulated ball seams traverse the fabric seams at different angles or do not contact a fabric seam at all.

Figure 5:
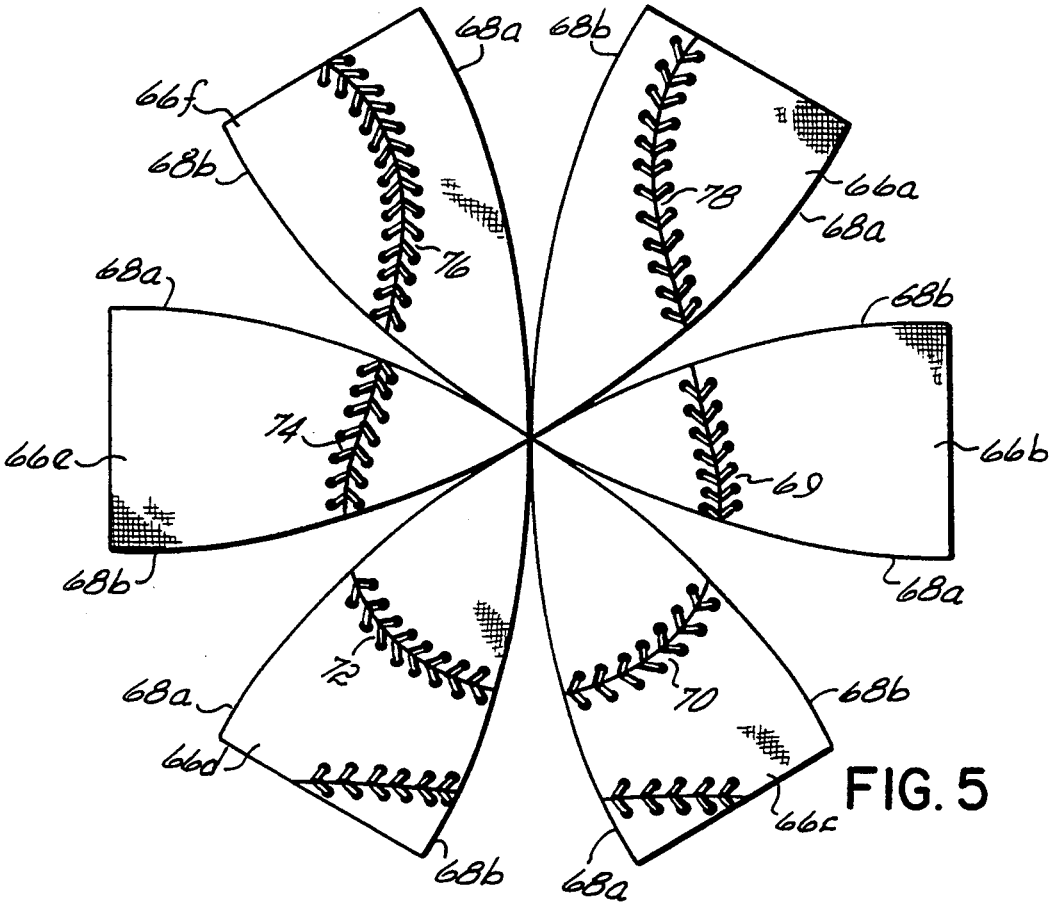
FIG. 5 is a top plan view of the unassembled fabric gores used to assemble a second alternative embodiment of the present invention.
Figure 6:
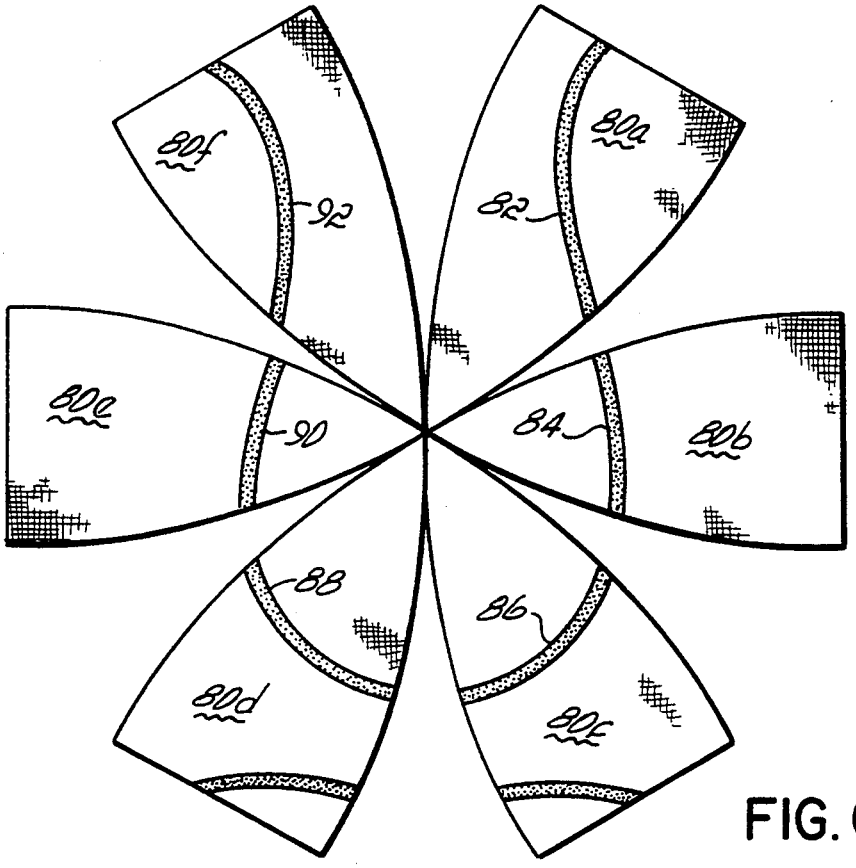
FIG. 6 is a top plan view of the unassembled fabric gores used to assemble a third alternative embodiment of the present invention.

FIGS. 5 and 6 show various other fabric gore sets which may be assembled together along opposing lengthwise edges to form the crown of other alternative embodiments of the present invention. Referring to FIG. 5, the fabric gores 66*a–f* include simulated ball seams, such as simulated seams 69, 70, 72, 74, 76, and 78. As may be appreciated from the foregoing discussion, when adjacent fabric gores 66*a–f* are secured together, along their opposing lengthwise edges 68*a* and 68*b*, they form approximately one-half of a simulated game ball, and the type of game ball simulated is determined by the fabric gore pattern and the simulated ball seams which appear in the pattern sections on the gores. Simulated seams 69, 70, 72, 74, 76, and 78 resemble the stitching and seams which are traditionally found on a baseball. Therefore, when the gores 66*a–f* of FIG. 5 are assembled together into the crown of the cap of the present invention, the pattern on the fabric gores forming the crown will simulate approximately one-half of a baseball.

Alternatively, the gores 80*a–f* shown in FIG. 6 have simulated seams, such as seams 82, 84, 86, 88, 90, and 92, which resemble the seams on the outside surface of a tennis ball. Therefore, when the gores 80*a–f* of FIG. 6 are assembled together to form the crown of the cap of the present invention, the simulated ball seams in the pattern sections of the fabric gores collectively form and simulate approximately one-half of a tennis ball. Additionally, as in the embodiments described above, the simulated ball seams in the pattern sections of the gores of FIGS. 5 and 6 will traverse the fabric seams between adjacent gores when those gores are assembled together to form the crown of the cap of the present invention.

While the present invention has been illustrated by the description and several alternative embodiments, and while these embodiments have been described in detail, it is not the intention of the Applicants to restrict or in anyway limit the scope of the appended claims to such detail. Additional advantages and modifications will readily appear to those skilled in the art. For example, while the crowns of the various alternative embodiments of the cap of the present invention are shown to simulate a soccer ball, a basketball, a baseball, and a tennis ball, other generally round balls can also be simulated by the pattern fabric gores of the present invention. For example, the dimples of a golf ball may be formed by simulated ball seams in the pattern sections of the fabric gores, and approximately half of a golf ball may be formed when these gores are secured together to form the crown of the cap of the present invention. The invention in its broader aspects is, therefore, not limited to the specific detail, representative apparatus and method, and illustrative examples shown and described. Accordingly, departures may be made from such details without departing from the spirit or scope of Applicant's general inventive concept.

I claim:

1. A simulated baseball cap comprising a plurality of generally triangular fabric gores having two opposing lengthwise edges and a base edge, said gores being connected one with another along said lengthwise edges to thereby form fabric gore seams, said connected gores defining the crown of said cap, and a baseball pattern formed on the outer surface of said gores wherein a section of said pattern is carried by each of said gores, said pattern including substantial portions of two peanut-shaped regions defined by a simulated ball seam and said pattern sections on said gores being aligned to simulate approximately one half of a baseball when said gores are connected, wherein said simulated ball seam traverses a majority of said fabric gore seams when said gores are connected.

* * * * *

UNITED STATES PATENT AND TRADEMARK OFFICE

CERTIFICATE OF CORRECTION

PATENT NO. : 5,343,567

DATED : September 6, 1994

INVENTOR(S) : Michael W. Zumbiel

It is certified that error appears in the above-identified patent and that said Letters Patent is hereby corrected as shown below:

At column 3, line 66 please delete "cream" and insert in its place -- create --

Signed and Sealed this

Twenty-eight Day of March, 1995

Bruce Lehman

*Attest:*

BRUCE LEHMAN

*Attesting Officer*

*Commissioner of Patents and Trademarks*